US005984044A

United States Patent [19]

Christensen

[11] Patent Number: 5,984,044

[45] Date of Patent: Nov. 16, 1999

[54] ACOUSTICAL BARRIER WALL WITH PROTECTIVE SLEEVES AND METHOD OF ASSEMBLY

[76] Inventor: Arthur E. Christensen, 1316 Dulaney Valley Rd, Towson, Md. 21286

[21] Appl. No.: 09/126,923

[22] Filed: Jul. 31, 1998

[51] Int. Cl.[6] ..... E04H 17/00

[52] U.S. Cl. ..... 181/210

[58] Field of Search ..... 181/210, 284, 181/285, 287, 288, 295; 52/144, 145

[56] References Cited

U.S. PATENT DOCUMENTS

| | | | |
|---|---|---|---|
| 2,132,032 | 10/1938 | Jacobsen . | |
| 3,948,009 | 4/1976 | Bernhard . | |
| 4,042,061 | 8/1977 | Murakami . | |
| 4,143,495 | 3/1979 | Hintz . | |
| 4,197,923 | 4/1980 | Harris et al. . | |
| 4,200,171 | 4/1980 | Seymour et al. . | |
| 4,325,457 | 4/1982 | Docherty et al. . | |
| 4,566,558 | 1/1986 | Link, Jr. et al. | 181/210 |
| 4,674,593 | 6/1987 | McCarty . | |
| 4,838,524 | 6/1989 | McKeown et al. . | |
| 5,406,039 | 4/1995 | Rerup et al. . | |
| 5,713,161 | 2/1998 | Veldhoen | 52/144 |

*Primary Examiner*—Khanh Dang

*Attorney, Agent, or Firm*—Seidul, Gonda Lavorgna and Monaco, PC

[57] ABSTRACT

An acoustical barrier wall includes a base; a plurality of acoustical panels sized for vertically stacked co-operating engagement, each panel having a top edge, a bottom edge, a first side edge, and a second side edge; at least one pair of H-beams spaced in a row and extending vertically upward from the base, one H-beam being adapted to supportingly receive the first side edge of each panel and the other H-beam being adapted to supportingly receive the second side edge of each panel; and means for protecting the first and second side edges of at least one panel. In the preferred embodiment, the means for protecting the first and second side edges is at least one protective sleeve mounted on the first or second side edge of at least one panel. The protective sleeve is slidably mounted on the side edge and is made of a plastic material, such as polyethylene.

21 Claims, 2 Drawing Sheets

ACOUSTICAL BARRIER WALL WITH PROTECTIVE SLEEVES AND METHOD OF ASSEMBLY

FIELD OF THE INVENTION

The present invention relates to acoustical barrier walls and in particular to protective sleeves for acoustical panels used in roadway acoustical barrier walls.

BACKGROUND OF THE INVENTION

Many roadways or highways, especially those near residential areas, have acoustical barrier walls to attenuate the sound level of traffic noise as it is perceived beyond the roadway. These barrier walls typically include panels which are made of concrete or similar materials and often have a decorative face of stone aggregate or similar materials. The panels usually are supported by vertically disposed metal H-beams that are anchored in the ground (or another base) and are spaced apart at a distance slightly greater than the width of the panels. Typically, multiple panels are stacked one on top of another in co-operating engagement between adjacent H-beams. The panels fit in interposed relation between the H-beams and are held in place at the side edges of the panels by the flanges (which form channels) of the H-beams.

The panels usually are put in place with a crane or other lifting device which lifts and then lowers each panel into place. Corrosion-resistant coatings on the surfaces inside the channels of the supporting H-beams may be gouged or scraped away during installation of the panels, and the corners and/or edges of the panels often are damaged when the panel edges ratchet in the channels of the H-beams while each panel is lowered in place. Broken or chipped corners or other portions of the panel edges create water collection pockets between the panel and the H-beam. When moisture collects in these areas, it promotes corrosion of the H-beams and/or fracture of the panel material when the moisture freezes. Such damage may be unseen when the panels are in place, and may progress to severe corrosion damage.

It is desired to have a means of protecting the edges of the panels in such acoustical barrier walls and an improved method of installing the panels to aid in the installation of the panels and prevent the edges of the panels from being damaged during installation.

It is further desired to have an improved installation method and a means of preventing the panel edges from damaging corrosion-resistant coatings on the surfaces inside the channels of the supporting H-beams.

It is still further desired to prevent the collection of moisture between the panels and the H-beams and thereby minimize potential for corrosion of the H-beam surfaces and cracking of the panels by freezing moisture.

SUMMARY OF THE INVENTION

The present invention is an acoustical barrier wall including one or more acoustical panels having resilient sleeves protecting the edges of the panels from damage, especially during installation of the panels in the wall. The present invention also includes a method of assembling the acoustical barrier wall having protective sleeves mounted on the edges of the panel.

In one embodiment, the acoustical barrier wall comprises: a base; at least one pair of H-beams spaced in a row and extending vertically 25 upward from the base; a plurality of acoustical panels sized for vertically stacked co-operating engagement in the H-beams; and at least one protective sleeve mounted on the side edge of at least one panel. The protective sleeve is slidably mounted on the side edge and is made of a resilient plastic material, such as polyethylene.

One variation of the above embodiments is to use only one acoustical panel between the pair of H-beams, rather than a plurality of stacked panels.

The present invention includes a method of assembling the acoustical barrier wall which includes multiple steps. The first step is to provide a base. The second step is to provide at least one acoustical panel adapted for vertically stacked co-operating engagement, each panel having a top edge, a bottom edge, a first side edge, and a second side edge. The third step is to mount a first protective sleeve on the first side edge of each panel. The fourth step is to mount another protective sleeve on the second side edge of each panel. The fifth step is to provide a pair of H-beams spaced in a row and extending vertically upward from the base, one H-beam being adapted to supportingly receive the first protective sleeve and the first side edge of each panel and the other H-beam being adapted to supportingly receive another protective sleeve and the second side edge of each panel. The final step is to insert at least one panel between the pair of H-beams, the first protective sleeve and each side edge of each panel being supportingly received by one H-beam and the other protective sleeve and the second side edge of each panel being supportingly received by the other H-beam.

In another embodiment of the method of assembling the acoustical barrier wall, the protective sleeves are mounted on the side edges and the adjacent portions of the top or bottom edges of each panel, rather than just on the side edges of each panel.

BRIEF DESCRIPTION OF THE DRAWINGS

For a better understanding of the present invention, reference is made to the accompanying drawings. The drawings show one embodiment of the invention as presently preferred. However, it should be understood that the invention is not limited to the precise arrangements and instrumentalities shown in the drawings.

DETAILED DESCRIPTION OF THE INVENTION

Figure 1:
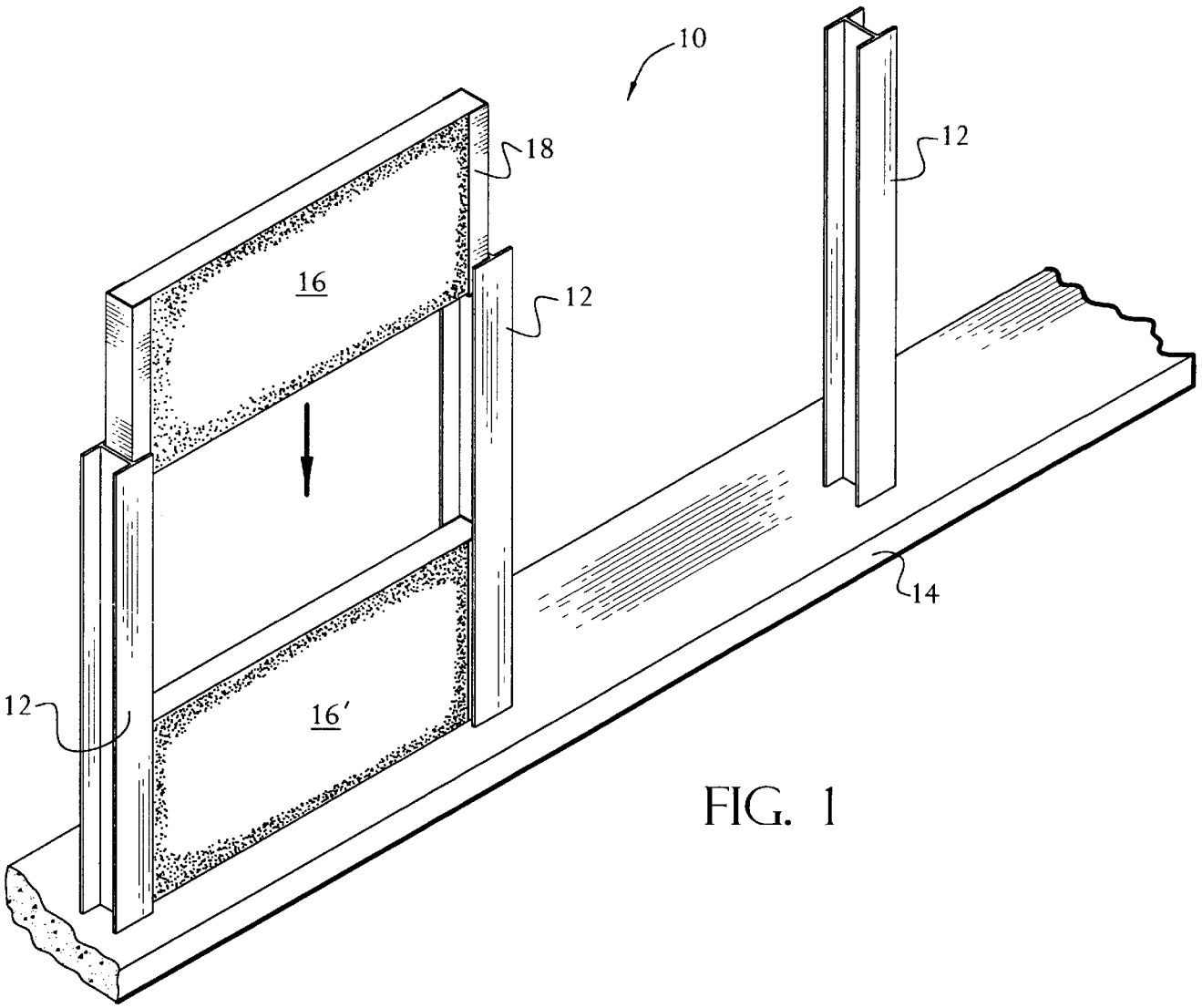
FIG. 1 is a perspective view illustrating an installation (in progress) between adjacent H-beams of several acoustical panels with protective sleeves according to the present invention.

Referring now to the drawings, where like elements are identified by like numerals, there is shown in FIG. 1 an acoustical barrier wall 10 being installed according to the present invention. H-beams (i.e., beams having an "H" shape in cross section) 12 are anchored in the ground or another base 14 and are spaced apart at a distance slightly greater than the width of the acoustical panels 16. Each panel has a top edge, a bottom edge, and first and second side edges, and the panels are sized for vertically stacked co-operating engagement between adjacent H-beams.

Although the H-beams 12 preferably are made of steel or other metals and the panels 16 are made of concrete, both of these components may be made of other materials. Also, although H-beams are preferred, other types of support members may be used if they have at least one vertically oriented channel adapted to supportingly receive a side edge of a panel.

In the preferred embodiment, multiple panels 16 are stacked one on top of another in cooperating engagement between vertically disposed H-beams 12. The panels fit in interposed relation between adjacent H-beams and are held in place at the side edges of the panels by the flanges (which form channels) of the H-beams. (In an alternate embodiment, only one panel is positioned between each pair of H-beams, rather than multiple panels.)

Figure 2B:
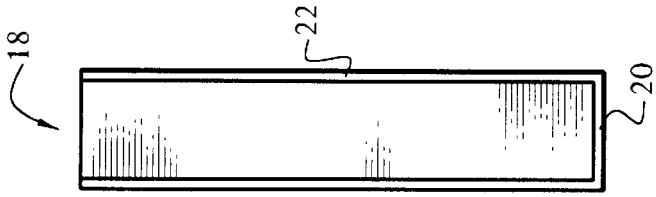
FIG. 2B is an illustration of an "open-ended" protective sleeve according to the present invention.
Figure 2A:
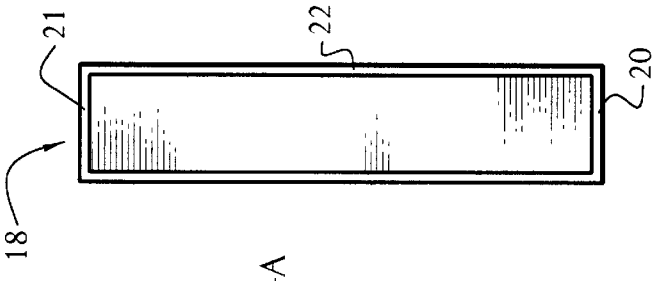
FIG. 2A is an illustration of a "close-ended" protective sleeve according to the present invention.

Before the panels 16 are put in place, protective sleeves 18 are mounted on the side edges of each panel. In the preferred embodiment, each protective sleeve is an elongated ⊔-shaped device (i.e., a 3-sided device forming a channel having a substantially rectangular shape) sized to fit snugly over a side edge of a panel and substantially cover the side edge from top to bottom. The protective sleeves 18 may be close-ended as shown in FIG. 2A or open-ended as shown in FIG. 2B. In the close-ended version, each end of the protective sleeve has a minor portion 20, 21 which is substantially perpendicular to the elongated sides of the major portion 22 of the sleeve. In the open-ended version, one end of the protective sleeve 18 has a minor portion 20 and the opposite end of the sleeve is open, having no such minor portion.

Protective sleeves 18 are mounted on the side edges of each panel 16. Each sleeve is slid over a side edge and fit snugly thereon so that the side edge is substantially covered by the sleeve and substantially all space is eliminated between the outer surfaces of the side edge of the panel and the inner surfaces of the protective sleeve.

In the preferred embodiment, the protective sleeves 18 are made of a plastic material, such as polyethylene. The inherent lubricity of the plastic lubricates the channels of the H-beams 12 making it easier to slide the panels 16 in place in the channels of the H-beams during installation.

Figure 4:
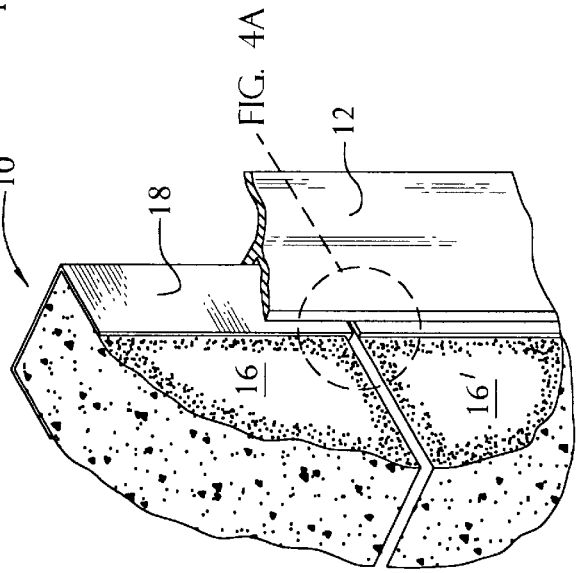
FIG. 4 is an enlarged perspective view of a section of several acoustical panels with protective sleeves installed in a channel of an H-beam as shown in FIG. 3.
Figure 3:
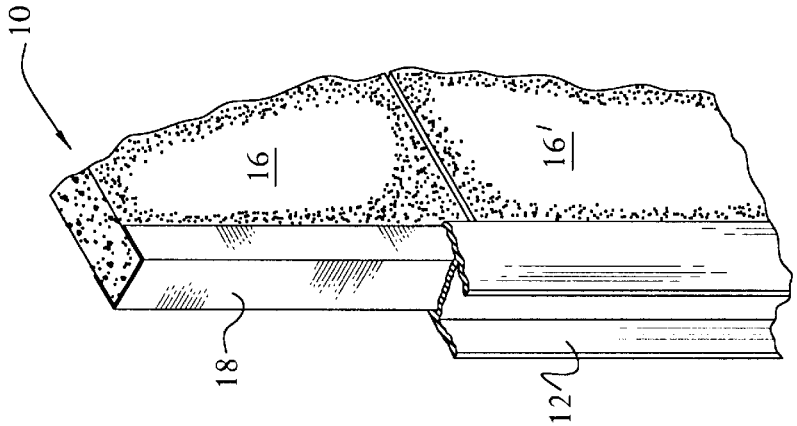
FIG. 3 is a perspective view of a section of several acoustical panels with protective sleeves installed in a channel of an H-beam.

The panels 16 are put in place by lifting each panel (with protective sleeves 18 mounted thereon) with a crane or other lifting device (not shown) and then lowering each panel into place, one on top of another. FIG. 1 illustrates a situation where one panel 16' already has been lowered into place and another panel 16 has been positioned and is about to be lowered on top of the first panel 16'. In FIGS. 3 and 4, panel 16 has been put in place on top of panel 16'.

In addition to aiding in the installation of the panels 16, the protective sleeves 18 help prevent the corners and edges of the panels from being damaged during installation. The protective sleeves also prevent the panel edges from damaging any corrosion-resistant coating which may be on the surfaces inside the channels of the supporting H-beams 12. By avoiding any breaking and/or cracking of corners or other portions of the panel edges during installation, the protective sleeves help prevent any formation of collection pockets for moisture between the panels and the H-beams (which preferably are metal). Preventing the collection of moisture between the panels and the H-beams minimizes the potential for corrosion of the H-beam surfaces and cracking of the panels by freezing moisture.

Figure 4A:
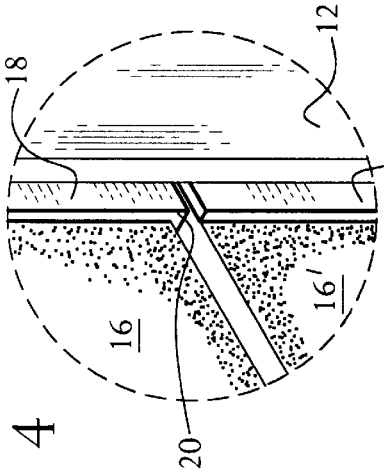
FIG. 4A is a detailed view of a portion of the assembly shown in FIG. 4.

For ease of illustrating the invention, FIGS. 4 and 4A show portions of the protective sleeves 18 extending horizontally beyond the flange of the H-beam 12. However, for aesthetic purposes, it may be better to have the protective sleeves completely or substantially covered by the flanges.

FIGS. 4 and 4A illustrate the use of an "open-end" protective sleeve 18. The detailed view in FIG. 4A shows how the minor portion 20 of the protective sleeve 18 on the upper panel 16 protects the corners of the panels and provides a separating means between the upper panel 16 and the lower panel 16'. In this illustration, the minor portion 20 is slidably mounted on the bottom edge of panel 16. Alternatively, protective sleeve 18' may be inverted so that minor portion 20' is slidably mounted on the top edge of panel 16'. This accomplishes the same result, i.e., it protects the corners of the panels and provides a separating means between the upper panel 16 and the lower panel 16'.

The present invention may be embodied in other variant forms where the variation does not substantially differentiate from the essential novelty and uniqueness revealed in the foregoing disclosure. Reference should therefore be made to the appended claims rather than the foregoing specification, as indicating the scope of the invention. It should be understood that many modifications, variations and changes may be made without departing from the spirit and scope of the invention as defined in the claims.

What is claimed is:

1. In a roadway acoustical barrier wall of the type having a plurality of H-beams spaced in a row and extending vertically upward from a base, and having a plurality of acoustical panels made of concrete and sized for vertically stacked co-operating engagement between adjacent H-beams, each panel having a top edge, a bottom edge, a first side edge, and a second side edge, the improvement comprising:

at least one protective sleeve mounted on a side edge of at least one acoustical panel.

2. An acoustical barrier wall as in claim 1, wherein the protective sleeve is slidably mounted on the side edge.

3. An acoustical barrier wall as in claim 1, wherein the protective sleeve is made of a plastic material.

4. An acoustical barrier wall as in claim 3, wherein the plastic material is polyethylene.

5. An acoustical barrier wall as in claim 1, wherein each H-beam has at least one vertically oriented channel adapted to supportingly receive the first or second side edge of each panel.

6. An acoustical barrier wall as in claim 5, wherein substantially all of the protective sleeve is disposed within the vertically oriented channel.

7. An acoustical barrier wall, comprising:

a base;

a plurality of acoustical panels made of concrete and sized for vertically stacked co-operating engagement, each panel having a top edge, a bottom edge, a first side edge, and a second side edge;

at least one pair of H-beams spaced in a row and extending vertically upward from the base, one H-beam being adapted to supportingly receive the first side edge of each panel and the other H-beam being adapted to supportingly receive the second side edge of each panel; and means for protecting the first and second side edges of at least one panel.

8. An acoustical barrier wall as in claim 7, wherein the means for protecting the first and second side edges is at least one protective sleeve mounted on the first or second side edge of at least one panel.

9. A method of assembling an acoustical barrier wall, comprising the steps of:

providing a base;

providing at least one acoustical panel made of concrete and adapted for vertically stacked co-operating engagement, each panel having a top edge, a bottom edge, a first side edge, and a second side edge;

mounting a first protective sleeve on the first side edge of each panel;

mounting another protective sleeve on the second side edge of each panel;

providing a pair of H-beams spaced in a row and extending vertically upward from the base, one H-beam being adapted to supportingly receive the first protective sleeve and the first side edge of each panel and the other H-beam being adapted to supportingly receive another protective sleeve and the second side edge of each panel; and inserting at least one panel between the pair of H-beams, the first protective sleeve and the first side edge of each panel being supportingly received by one H-beam and the other protective sleeve and the second side edge of each panel being supportingly received by the other H-beam.

10. An acoustical barrier wall including a base, at least one pair of H-beams spaced in a row and extending vertically upward from the base, and a plurality of acoustical panels made of concrete and adapted for vertically stacked co-operating engagement between the H-beams, each panel having a top edge, a bottom edge, a first side edge, and a second side edge, one H-beam being adapted to supportingly receive the first side edge of each panel and the other H-beam being adapted to supportingly receive the second side edge of each panel, the improvement comprising:

at least one protective sleeve having an elongated major portion and a minor portion substantially perpendicular to one end of the major portion, the major portion being mounted on the first or second side edge of at least one panel and the minor portion being mounted on either the top edge or the bottom edge adjacent the first or second side edge having the major portion of the protective sleeve mounted thereon.

11. An acoustical barrier wall as in claim 10, wherein the protective sleeve is slidably mounted on the side edge and on the top or bottom edge.

12. An acoustical barrier wall as in claim 10, wherein the protective sleeve is made of a plastic material.

13. An acoustical barrier wall as in claim 12, wherein the plastic material is polyethylene.

14. An acoustical barrier wall as in claim 10, wherein each H-beam has at least one vertically oriented channel adapted to supportingly receive the first or second side edge of each panel.

15. An acoustical barrier wall as in claim 14, wherein substantially all of the major portion of the protective sleeve is disposed within the vertically oriented channel.

16. An acoustical barrier wall, comprising:

a base;

a plurality of acoustical panels made of concrete and adapted for vertically stacked co-operating engagement, each panel having a top edge, a bottom edge, a first side edge, and a second side edge;

at least one pair of H-beams spaced in a row and extending vertically upward from the base, one H-beam being adapted to supportingly receive the first side edge of each panel and the other H-beam being adapted to supportingly receive the second side edge of each panel; and means for protecting the first and second side edges and adjacent portions of the top edge or the bottom edge of at least one panel.

17. An acoustical barrier wall as in claim 16, wherein the means for protecting the first and second side edges and adjacent portions of the top edge or the bottom edge of at least one panel is at least one protective sleeve having an elongated major portion and a minor portion substantially perpendicular to one end of the major portion, the major portion being mounted on the first or second side edge of at least one panel and the minor portion being mounted on either the top edge or the bottom edge adjacent the first or second side edge having the major portion of the protective sleeve mounted thereon.

18. A method of assembling an acoustical barrier wall, comprising the steps of:

providing a base;

providing at least one acoustical panel made of concrete and adapted for vertically stacked co-operating engagement, each panel having a top edge, a bottom edge, a first side edge, and a second side edge;

mounting a first protective sleeve on the first side edge and an adjacent portion of the top or bottom edge of each panel;

mounting another protective sleeve on the second side edge and an adjacent portion of the top or bottom edge of each panel;

providing a pair of H-beams spaced in a row and extending vertically upward from the base, one H-beam being adapted to supportingly receive the protective sleeve and first side edge of each panel and the other support member being adapted to supportingly receive another protective sleeve and the second side edge of each panel; and inserting at least one panel between the pair of H-beams, the first protective sleeve and each side edge of the first panel being supportingly received by one H-beam and the other protective sleeve and the second side edge of each panel being supportingly received by the other H-beam.

19. An acoustical barrier wall, comprising:

a base;

an acoustical panel made of concrete and having a top edge, a bottom edge, a first side edge, and a second side edge;

at least one pair of H-beams spaced in a row and extending vertically upward from the base, one H-beam being adapted to supportingly receive the first side edge of the panel and the other H-beam being adapted to supportingly receive the second side edge of the panel; and at least one protective sleeve mounted on the first or second side edge of the panel.

20. An acoustical barrier wall, comprising:

a base;

an acoustical panel made of concrete and having a top edge, a bottom edge, a first side edge, and a second side edge;

at least one pair of H-beams spaced in a row and extending vertically upward from the base, one H-beam being adapted to supportingly receive the first side edge of the panel and the other H-beam being adapted to supportingly receive the second side edge of the panel; and means for protecting the first and second side edges and adjacent portions of the top edge or the bottom edge of the panel.

21. An acoustical barrier wall as in claim 20, wherein the means for protecting the first and second side edges and adjacent portions of the top edge or the bottom edge of the panel is at least one protective sleeve having an elongated major portion and a minor portion substantially perpendicular to one end of the major portion, the major portion being mounted on the first or second side edge of the panel and the minor portion being mounted on either the top edge or the bottom edge adjacent the first or second side edge having the major portion of the protective sleeve mounted thereon.

* * * * *